US007097551B2

(12) United States Patent
Easley et al.

(10) Patent No.: US 7,097,551 B2
(45) Date of Patent: Aug. 29, 2006

(54) CUTTING TOOLS WITH TWO-SLOPE PROFILE

(75) Inventors: Thomas Charles Easley, Bexley, OH (US); Shan Wan, Lewis Center, OH (US)

(73) Assignee: Diamond Innovations, Inc., Worthington, OH (US)

( * ) Notice: Subject to any disclaimer, the term of this patent is extended or adjusted under 35 U.S.C. 154(b) by 0 days.

(21) Appl. No.: 11/082,487

(22) Filed: Mar. 17, 2005

(65) Prior Publication Data

US 2005/0161035 A1 Jul. 28, 2005

Related U.S. Application Data

(63) Continuation of application No. 10/455,008, filed on Jun. 5, 2003, now Pat. No. 6,994,615.

(60) Provisional application No. 60/395,181, filed on Jul. 10, 2002.

(51) Int. Cl.
*B24B 33/00* (2006.01)

(52) U.S. Cl. ..... 451/542; 451/544; 451/548

(58) Field of Classification Search ..... 451/540, 451/542, 544, 547, 548; 51/307; 175/420.1, 175/420.2

See application file for complete search history.

(56) References Cited

U.S. PATENT DOCUMENTS

| | | | |
|---|---|---|---|
| 3,136,615 | A | 6/1964 | Bovenkerk et al. |
| 3,141,746 | A | 7/1964 | De Lai |
| 3,233,988 | A | 2/1966 | Wentorf, Jr. et al. |
| 3,743,489 | A | 7/1973 | Wentorf, Jr. et al. |
| 3,745,623 | A | 7/1973 | Wentorf, Jr. et al. |
| 3,767,371 | A | 10/1973 | Wentorf, Jr. et al. |
| 4,109,737 | A | 8/1978 | Bovenkerk |
| 5,351,772 | A | 10/1994 | Smith |
| 5,374,854 | A | 12/1994 | Chen |
| 5,484,330 | A | 1/1996 | Flood et al. |
| 5,486,137 | A | 1/1996 | Flood et al. |
| 5,494,477 | A | 2/1996 | Flood et al. |
| 5,743,346 | A | 4/1998 | Flood et al. |
| 5,971,087 | A | 10/1999 | Chaves |

*Primary Examiner*—M. Rachuba
(74) *Attorney, Agent, or Firm*—Pepper Hamilton LLP

(57) ABSTRACT

An abrasive tool insert is formed from a substrate having an inner face that has a center. The inner face slopes outwardly and downwardly from the center. An annular face slopes downwardly and outwardly from the inner face. An abrasive layer, having a center and a periphery forming a cutting edge, is integrally formed on the substrate.

9 Claims, 2 Drawing Sheets

CUTTING TOOLS WITH TWO-SLOPE PROFILE

CROSS-REFERENCE TO RELATED APPLICATIONS

This application is a continuation of U.S. patent application Ser. No. 10/455,008 filed Jun. 5, 2003, now U.S. Pat. No. 6,994,615, which claims the benefit of U.S. Provisional Application Ser. No. 60/395,181 filed Jul. 10, 2002, both of which are hereby incorporated herein by reference.

BACKGROUND OF THE INVENTION

The present invention relates to the field of abrasive tool inserts and, more particularly, to such inserts having a support with a central downwardly sloping profile and an outer steeper sloping profile, which reduces the surface axial residual stresses by 83% compared to a flat, planar interface and by 23% compared to a substrate with a single sloped rim. The reduction of the surface axial residual stress increases the impact performance and extends the working lifetime of the cutting tool.

Abrasive compacts are used extensively in cutting, milling, grinding, drilling and other abrasive operations. An abrasive particle compact is a polycrystalline mass of abrasive particles, such as diamond and/or cubic boron nitride (CBN), bonded together to form an integral, tough, high-strength mass. Such components can be bonded together in a particle-to-particle self-bonded relationship, by means of a bonding medium disposed between the particles, or by combinations thereof. The abrasive particle content of the abrasive compact is high and there is an extensive amount of direct particle-to-particle bonding. Abrasive compacts are made under elevated or high pressure and temperature (HP/HT) conditions at which the particles, diamond or CBN, are crystallographically stable. For example, see U.S. Pat. Nos. 3,136,615, 3,141,746, and 3,233,988.

A supported abrasive particle compact, herein termed a composite compact, is an abrasive particle compact, which is bonded to a substrate material, such as cemented tungsten carbide.

Abrasive compacts tend to be brittle and, in use, they frequently are supported by being bonded to a cemented carbide substrate. Such supported abrasive compacts are known in the art as composite abrasive compacts. Compacts of this type are described, for example, in U.S. Pat. Nos. 3,743,489, 3,745,623, and 3,767,371. The bond to the support can be formed either during or subsequent to the formation of the abrasive particle compact. Composite abrasive compacts may be used as such in the working surface of an abrasive tool.

Composite compacts have found special utility as cutting elements in drill bits. Drill bits for use in rock drilling, machining of wear resistant materials, and other operations which require high abrasion resistance or wear resistance generally consist of a plurality of polycrystalline abrasive cutting elements fixed in a holder. Particularly, U.S. Pat. Nos. 4,109,737 and 5,374,854, describe drill bits with a tungsten carbide stud (substrate) having a polycrystalline diamond compact on the outer surface of the cutting element. A plurality of these cutting elements then are mounted generally by interference fit into recesses into the crown of a drill bit, such as a rotary drill bit. These drill bits generally have means for providing water-cooling or other cooling fluids to the interface between the drill crown and the substance being drilled during drilling operations. Generally, the cutting element comprises an elongated pin of a metal carbide (stud) which may be either sintered or cemented carbide (such as tungsten carbide) with an abrasive particle compact (e.g., polycrystalline diamond) at one end of the pin for form a composite compact.

Fabrication of the composite compact typically is achieved by placing a cemented carbide substrate into the container of a press. A mixture of diamond grains or diamond grains and catalyst binder is placed atop the substrate and compressed under HP/HT conditions. In so doing, metal binder migrates from the substrate and "sweeps" through the diamond grains to promote a sintering of the diamond grains. As a result, the diamond grains become bonded to each other to form a diamond layer, which concomitantly is bonded to the substrate along a conventionally planar interface. Metal binder can remain disposed in the diamond layer within pores defined between the diamond grains.

A composite compact formed in the above-described manner may be subject to a number of shortcomings. For example, the coefficients of thermal expansion and elastic constants of cemented carbide and diamond are close, but not exactly the same. Thus, during heating or cooling of the polycrystalline diamond compact (PDC), thermally induced stresses occur at the interface between the diamond layer and the cemented carbide substrate, the magnitude of these stresses being dependent, for example, on the disparity in thermal expansion coefficients and elastic constants.

Another potential shortcoming, which should be considered, relates to the creation of internal stresses within the diamond layer, which can result in a fracturing of that layer. Such stresses also result from the presence of the cemented carbide substrate and are distributed according to the size, geometry, and physical properties of the cemented carbide substrate and the polycrystalline diamond layer.

Recently, various PDC structures have been proposed in which the diamond/carbide interface contains a number of non-planar features designed to increase the mechanical bond and reduce thermally induced residual stresses. For example, U.S. Pat. No. 5,351,772 presents various interface designs containing radial raised lands on the substrate. However, high tensile residual stresses still exist at the diamond surface and near the interface in those designs. U.S. Pat. No. 5,484,330 suggests a sawtooth shaped cross-sectional profile and U.S. Pat. No. 5,494,777 proposes an outward sloping profile in the interface design. U.S. Pat. No. 5,743,346 proposes an interface having an inner surface and an outer chamfer that forms a 5° to 85° angle to the vertical, wherein the inner surface is other than the chamfer. U.S. Pat. No. 5,486,137 also proposes a tool insert having an outer downwardly sloped interface surface. U.S. Pat. No. 6,949,477 proposes a tool insert having an outer downwardly sloping interface. U.S. Pat. No. 5,971,087 also proposes various dual and triple slope interface profiles.

However, these patents do not propose the incorporation of a sloped profile in the interior of the cutter. Such a sloped profile combined with a steeper slope on the outer edge of the cutter, further reduces the surface residual stresses. Accordingly, it would be highly desirable to provide a polycrystalline diamond compact having reduced axial, radial, and hoop stresses. It is to such cutters that the present invention is addressed.

SUMMARY

An abrasive tool insert includes a substrate having an inner face that has a center, an annular face and an abrasive layer. The inner face slopes outwardly and downwardly from the center. The annular face slopes downwardly and outwardly from the inner face. A continuous abrasive layer, having a center and a periphery forming a cutting edge, is integrally formed on the substrate.

The substrate may include cemented metal carbide. The abrasive layer may include diamond, cubic boron nitride, wurtzite boron nitride, or a combination thereof. The abrasive layer may have a thickness of at least about 0.1 mm. The annular face may terminate in a ledge surrounding the periphery of the annular face.

Another embodiment of the abrasive tool insert includes a substrate, an annular face and an abrasive layer. The substrate includes an inner face which has a center. The inner face slopes outwardly and downwardly from the center at an angle from about 5° to about 15°. The annular face slopes downwardly and outwardly from the inner face at an angle of from about 20° to about 75°. The abrasive layer includes a cutting edge and is integrally formed on the substrate. The abrasive layer has a thickness of at least about 0.1 mm.

An interface between the substrate and the abrasive layer may be non-planar. The substrate may include cemented metal carbide. The cemented metal carbide may include a Group IVB, Group VB, or Group VIB metal carbide or a combination thereof. The abrasive layer may include diamond, cubic boron nitride, wurtzite boron nitride, or a combination thereof. The non-planar interface may include a sawtooth pattern of concentric rings.

Advantages of the present invention include the increase of the useful life of abrasive tool inserts by reducing the thermally induced residual radial and axial stresses in the abrasive layer. Another advantage is the ability to increase the impact performance and extend the working life of the cutting tools. These and other advantages will be readily apparent to those skilled in the art.

BRIEF DESCRIPTION OF THE DRAWINGS

For a fuller understanding of the nature and advantages of the present invention, reference should be had to the following detailed description taken in connection with the accompanying drawings, in which.

The drawings will be described in detail below.

DETAILED DESCRIPTION OF THE INVENTION

Figure 1:
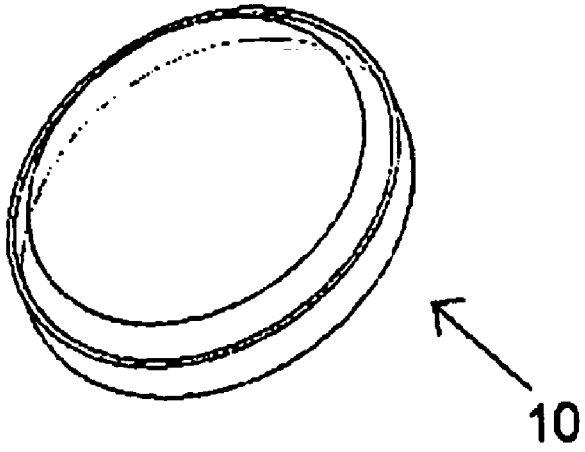
FIG. 1 is an overhead view of one embodiment of the interface configuration of the present invention.
Figure 2:
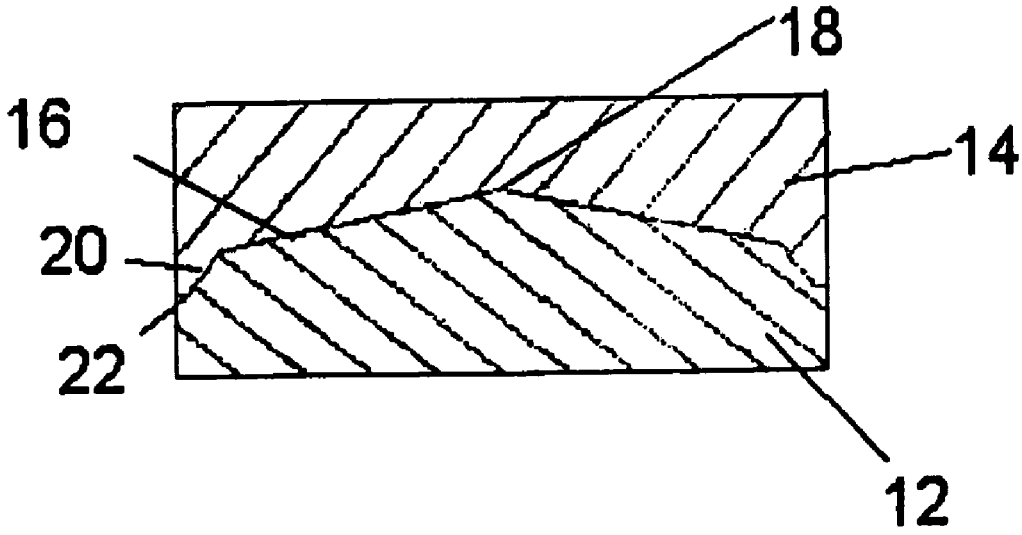
FIG. 2 is a cross-sectional elevational view of the substrate of FIG. 1.

The shape of the carbide support in FIGS. 1 and 2 is unique in that it contains 2 distinctive faces of support for the abrasive material, each face being disposed at an angle (relative to the horizontal) so as to optimized (minimize) radial stress and axial stress. To that end, a cutter, 10, is formed from a lower support, 12, and an upper abrasive layer, 14 (see FIG. 2). Support 12 has a central, inner face, 16, that extends outwardly and downwardly from an apex or center, 18. Surrounding face 18 is an outer annular face, 20, that extends outwardly and downwardly from the outer periphery of face 16. A slight ledge, 22, surmounts the outer periphery of annular face 20. Superimposed on inner face 16 can be sawtooth annuli and troughs, such as are proposed in U.S. Pat. No. 6,315,652.

In order to optimize (minimize) radial stress, outer annular face 20 should slope downwardly from the horizontal at an angle of between about 20° and about 75° with about 45° being preferred. In order to optimize (minimize) axial stress, inner face 16 should slope downwardly from the horizontal at an angle of between about 5' and about 15' with about 7.5° being preferred.

Figure 3:
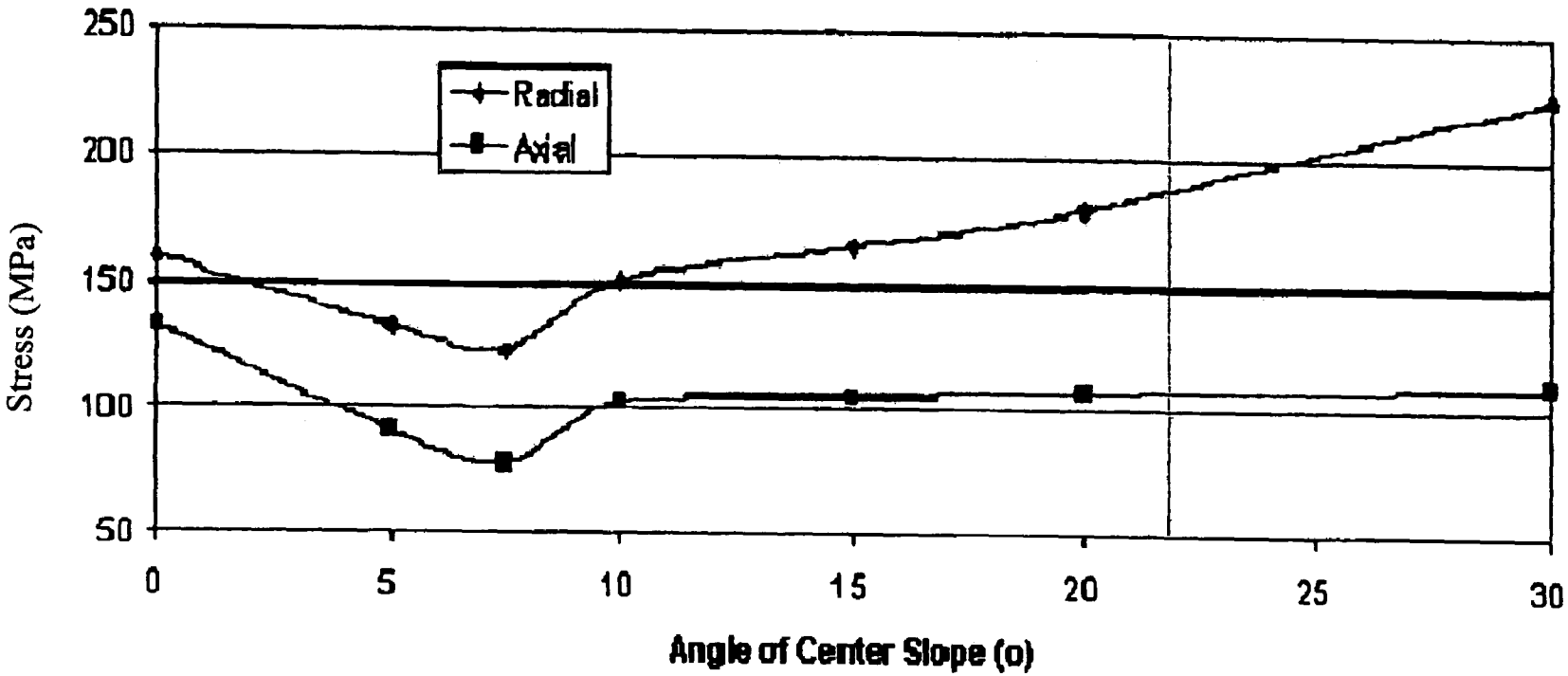
FIG. 3 graphically displays the stress (MPa) versus inner face angle for a cutter element having the profile as depicted in FIG. 2.

Such angles were determined by conducting finite element analysis. Additionally, data was extrapolated from the finite element analysis modeling, which data reflected the radial axial stress of 3.0 mm cylindrical carbide supported compacts 1.25 mm in height, wherein the outer annular face had an angle of about 45° with respect to the horizontal, while the inner face angle varied between about 0' and 30' from the horizontal. The results of work is set forth in FIG. 3. It will be observed that both radial and axial stress was minimized at about 7.5° with an optimized (minimized) range of stresses being expected at about 5° to 15° from the horizontal.

In interrupted cut impact testing on a granite block in a fly cutter configuration using of the inventive dual slope tool inserts compared to a single slope tool insert, an unexpected improvement in impact resistance was demonstrated.

The polycrystalline upper layer preferably is polycrystalline diamond (PCD). However, other materials that are included within the scope of this invention are synthetic and natural diamond, cubic boron nitride (CBN), wurtzite boron nitride, combinations thereof, and like materials. Polycrystalline diamond, however, is the preferred polycrystalline layer. The cemented metal carbide substrate is conventional in composition and, thus, may be include any of the Group IVB, VB, or VIB metals, which are pressed and sintered in the presence of a binder of cobalt, nickel or iron, or alloys thereof. The preferred metal carbide is tungsten carbide.

Further, in the practice of this invention, the outer surface configuration of the diamond layer is not critical. The surface configuration of the diamond layer, then, may be hemispherical, planar, conical, reduced or increased radius, chisel, or non-axisymmetric in shape. In general, all forms of tungsten carbide inserts used in the drilling industry may be enhanced by the addition of a diamond layer, and further improved by the current invention by addition of a pattern of ridges, as disclosed herein.

The disclosed abrasive tool insert is manufactured by conventional high pressure/high temperature (HP/HT) techniques well known in the art. Such techniques are disclosed, inter alia, in the art cited above.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

What is claimed is:

1. A tool insert, which comprises:

a substrate having an inner face which has a center, the inner face sloping outwardly and downwardly from the center;

an annular face which slopes downwardly and outwardly from the inner face;

a ledge surrounding an outer periphery of the annular face; and an abrasive layer having a center and a periphery a cutting edge, the abrasive layer integrally formed on the substrate and having a thickness of at least about 0.1 mm.

2. The tool insert of claim 1, wherein the substrate comprises cemented metal carbide.

3. The tool insert of claim 1, wherein the abrasive layer comprises diamond, cubic boron nitride, wurtzite boron nitride, or a combination thereof.

4. An abrasive tool insert, comprising:

a substrate having an inner face which has a center, the inner face sloping outwardly and downwardly from said center at an angle from about 5° to about 15°;

an annular face which slopes downwardly and outwardly from the inner face at an angle of from about 20° to about 75°;

a ledge surrounding an outer periphery of the annular face; and an abrasive layer having a cutting edge, the abrasive layer being integrally formed on the substrate, wherein the abrasive layer has a thickness of at least about 0.1 mm.

5. The tool insert of claim 4, wherein an interface between the substrate and the abrasive layer is non-planar.

6. The tool insert of claim 4, wherein the substrate comprises cemented metal carbide.

7. The tool insert of claim 6, wherein the cemented metal carbide comprises a Group IVB, Group VB, or Group VIB metal carbide or a combination thereof.

8. The tool insert of claim 4, wherein the abrasive layer comprises diamond, cubic boron nitride, wurtzite boron nitride, or a combination thereof.

9. The tool insert of claim 4, wherein the non-planar interface comprises a sawtooth pattern of concentric rings.

* * * * *